US008141211B2

(12) United States Patent
Weyer et al.

(10) Patent No.: US 8,141,211 B2
(45) Date of Patent: Mar. 27, 2012

(54) BUTTON ENGAGING AND ATTACHMENT APPARATUS AND METHODS RELATED APPLICATIONS

(75) Inventors: Leslie Weyer, Brownsville, WI (US); Bruce Weyer, Campbellsport, WI (US)

(73) Assignee: Tecre Co., Inc., Fond du Lac, WI (US)

( * ) Notice: Subject to any disclaimer, the term of this patent is extended or adjusted under 35 U.S.C. 154(b) by 906 days.

(21) Appl. No.: 12/156,722

(22) Filed: Jun. 3, 2008

(65) Prior Publication Data

US 2009/0049666 A1 Feb. 26, 2009

Related U.S. Application Data

(63) Continuation-in-part of application No. 29/291,296, filed on Aug. 22, 2007, now Pat. No. Des. 578,432, and a continuation-in-part of application No. 29/291,272, filed on Aug. 22, 2007, now Pat. No. Des. 578,431.

(51) Int. Cl.
*A44B 1/42* (2006.01)

(52) U.S. Cl. ..... 24/113 R; 24/113 MP; 24/104; 24/107

(58) Field of Classification Search ..... None
See application file for complete search history.

(56) References Cited

U.S. PATENT DOCUMENTS

| | | | | | |
|---|---|---|---|---|---|
| 2,220,038 | A * | 10/1940 | Kreisler et al. | ..... | 40/725 |
| 2,640,238 | A * | 6/1953 | Schuhr | ..... | 24/113 R |
| 3,670,524 | A * | 6/1972 | Korwin | ..... | 63/18 |
| 4,793,155 | A * | 12/1988 | Law | ..... | 63/40 |
| 7,743,471 | B2 * | 6/2010 | Rogers | ..... | 24/3.12 |

* cited by examiner

*Primary Examiner* — Jack W. Lavinder
(74) *Attorney, Agent, or Firm* — Ryan Kromholz & Manion, S.C.

(57) ABSTRACT

A button engaging and attachment structure includes a button engaging portion having button engaging tabs, and a button attachment portion adapted to couple to a host carrier.

14 Claims, 9 Drawing Sheets

BUTTON ENGAGING AND ATTACHMENT APPARATUS AND METHODS RELATED APPLICATIONS

RELATED APPLICATIONS

This application is a continuation-in-part of U.S. design patent application Ser. No. 29/291,296 filed 22 Aug. 2007 now U.S. Pat. No. D578,432. This application is also a continuation-in-part of U.S. design patent application Ser. No. 29/291,272 filed 22 Aug. 2007 now U.S. Pat. No. D578,431, both of which are incorporated herein by reference.

FIELD OF THE INVENTION

This invention relates to a button engaging and attachment structure, and more particularly to fastening a typical button to a button engaging structure and attaching the structure to a structure engaging device, such as a zipper pull.

BACKGROUND OF THE INVENTION

For the purposes of this invention, the term "button" and "buttons" are used herein to describe multi-component assemblies as shown in FIGS. 1, 1A, 1B, and 1C.

A typical button is assembled with a flexible laminate 1, which normally includes a sheet of artwork 3 and a protective transparent film 5, and is overlaid on a domed shell 7 having an annular wall 8. However, it is not necessary that the artwork 3 and transparent film 5 be bonded to each other. The term "laminate" includes artwork and transparent films that are both separated pieces and bonded pieces. The laminate 1 has a skirt portion 11 that overhangs the free edge 13 of the shell wall 8. A formed back 9, which is usually made of steel, is placed against the shell in a manner that tucks the skirt 11 of the laminate around the free edge 13 of the shell wall. The shell wall is crimped around its free edge against an outer frusto-conical wall 15 of the back 9, thereby bending the wall 8 of the shell and assembling the button 17. The finished button 17 has a three dimensional appearance that enhances the visual appeal of the artwork 3.

It will be noticed that the shell wall 8 has become frusto-conical in shape, as is shown at reference numeral 19 in FIG. 1B, and also that the laminate skirt 11 is tucked between the shell wall 19 and the back wall 15. Those two structural features are characteristic of buttons. FIG. 1C shows a typical prior button 18 that is made in a similar fashion with a collet 20 instead of a formed back 9.

Buttons are typically a novelty item, and are known in the art by a variety of names, such as "campaign button" and "pin". Buttons are limited in their use due to a lack of simple and convenient means for securement to host items, such as zippers, key-chains, clothing, book bags, and luggage, as non-limiting examples. Buttons are typically secured to clothing using a pin 21 on the back side of the button 17, as shown in FIG. 2, or with a bendable metal tab 22 which folds over a lapel or pocket, as shown in FIG. 3.

What is needed is a structure that simply and conveniently fastens to a button, and includes means for attaching the button to a host carrier.

SUMMARY OF THE INVENTION

The present invention relates to button engaging and attachments structure having button engaging tabs and a button attachment portion.

On aspect of the invention provides apparatus and methods comprising a structure for engaging a component of a button. The structure comprises a button engaging portion and a carrier attachment portion. The button engaging portion comprises a front portion and a back portion, with the front portion comprises a button engaging segment having one or more button engaging tabs extending therefrom, and the back portion comprises a rim.

The carrier attachment portion comprises a tab adapted to couple to a host carrier, the carrier attachment portion being coupled to the button engaging portion.

Another aspect of the invention provides apparatus and methods comprising a structure for engaging a component of a button. The structure comprises a button engaging portion and a carrier attachment portion. The button engaging portion comprises a first button engaging segment having one or more first button engaging tabs extending therefrom, and a second button engaging segment having one or more second button engaging tabs extending therefrom. A rim is positioned between the first button engaging segment and the second button engaging segment.

The carrier attachment portion comprises a tab adapted to couple to a host carrier, the carrier attachment portion being coupled to the button engaging portion.

Yet another aspect of the invention provides apparatus and methods comprising methods of mounting a button to a structure. A method comprises providing a structure comprising a button engaging portion, the button engaging portion comprises a front portion and a back portion, the front portion comprises a button engaging segment having one or more button engaging tabs extending therefrom, and the back portion comprises a rim, providing a button having a collet, positioning the button with the collet on top of the button engaging portion, and applying a force to the button allowing the collet to extend outward and slide over the button engaging tab while the button engaging tab extends inward until the collet slips under the button engaging tab, thereby mounting the button to the structure.

Other features and advantages of the invention shall be apparent based upon the accompanying description, drawings, and claims.

DESCRIPTION OF THE PREFERRED EMBODIMENT

Figure 1:
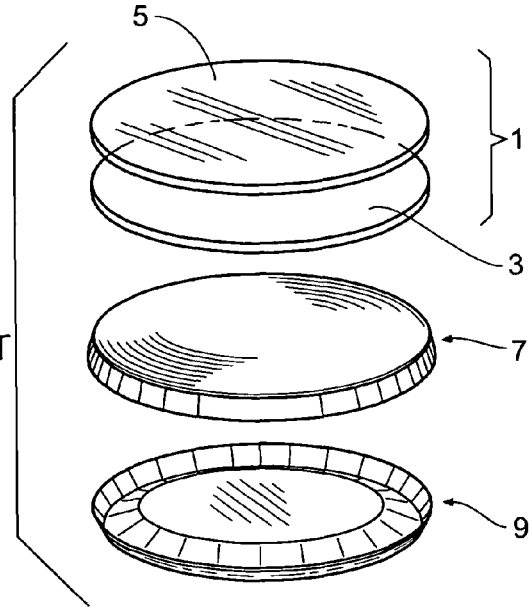
Fig. 1 PRIOR ART
FIG. 1 is an exploded perspective view of a prior button.
Figure 1A:
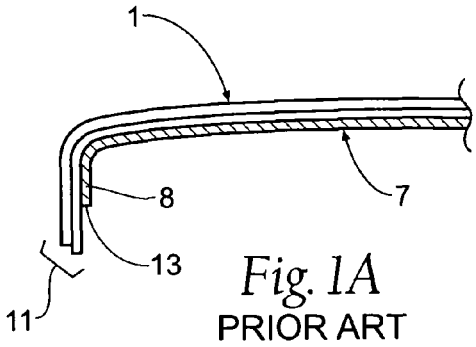
Fig. 1A PRIOR ART
FIG. 1A is a partial cross sectional view of a prior button shown in a partial assembled condition.
Figure 1B:
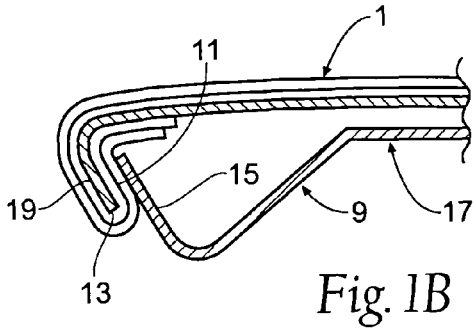
Fig. 1B PRIOR ART
FIG. 1B is a partial cross sectional view of the button of FIG. 1A, but showing the button in a fully assembled condition.
Figure 1C:
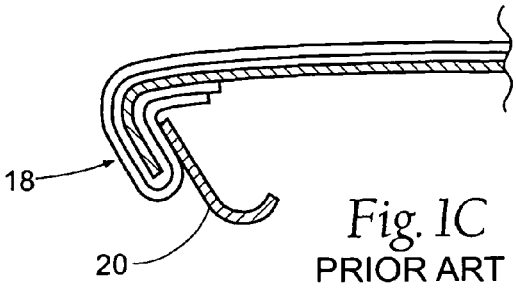
Fig. 1C PRIOR ART
FIG. 1C is a view similar to FIG. 1B, but showing a button made with a collet.
Figure 2:
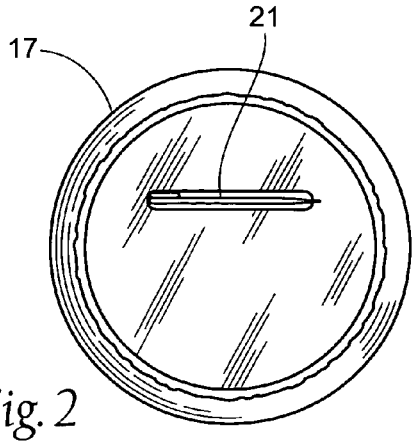
FIG. 2 is a rear view of a button showing a safety pin style connector for mounting the button to an article of clothing.
Figure 3:
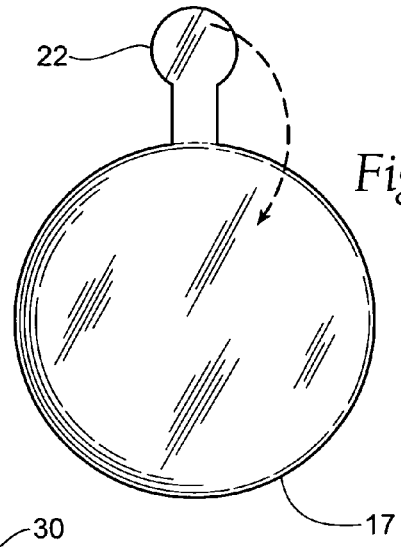
FIG. 3 is a rear view of another embodiment of a button showing a bendable tab for folding over a lapel or pocket to mount the button to an article of clothing.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Referring now to the drawings, wherein like numerals represent like parts throughout the views, there is generally designated at 30 a button engaging and attachment structure adapted to support a button 24. As seen particularly in FIGS. 4 through 8, the button engaging and attachment structure 30 includes a button engaging portion 40 and a carrier attachment portion 70. The button engaging and attachment structure 30 can comprise a unitary structure made of plastics, metals, woods, for example, or can comprise a number of discrete components that are secured together to form the button engaging and attachment structure 30. Discrete components can be secured together using known means, such as glue, screws, heat, and ultrasonic welding, as non-limiting examples.

The generally round shaped button engaging portion 40 comprises a front portion 42 and a back portion 44. It is to be appreciated that the button engaging portion 40 can take on a variety of non-circular shapes to engage a non-circular shaped button.

Figure 4:
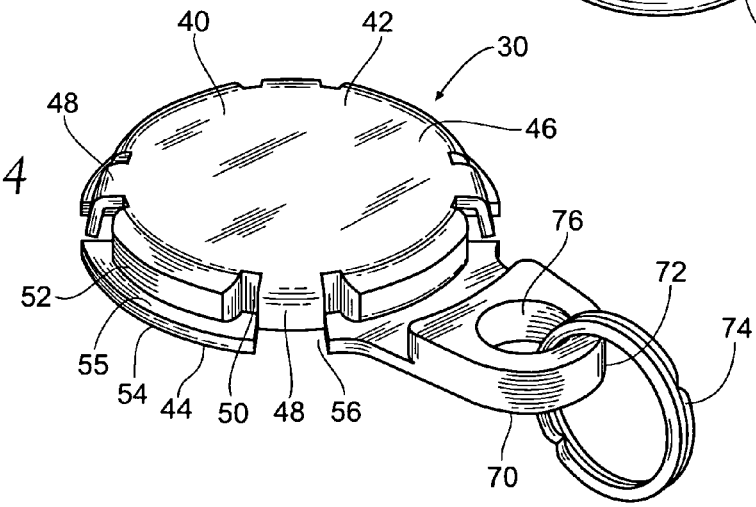
FIG. 4 is a perspective view of a button engaging and attachment structure.

The front portion 42 comprises a raised button engaging segment 46 having a height H1 (see FIG. 5) and a diameter D1 (see FIG. 6), with one or more button engaging tabs 48 extending therefrom (four button engaging tabs are shown). In one embodiment, the button engaging tab 48 extends from a recess 50 in the outer edge 52 of the button engaging segment 46, as seen in FIG. 4, and in an alternative embodiment, the button engaging tab 48 extends from the outer edge 52 of the button engaging segment 46 (see FIG. 8). It is to be appreciated that extending from the button engaging segment 46 can include extending from any portion of the raised button engaging segment 46.

Figure 9:
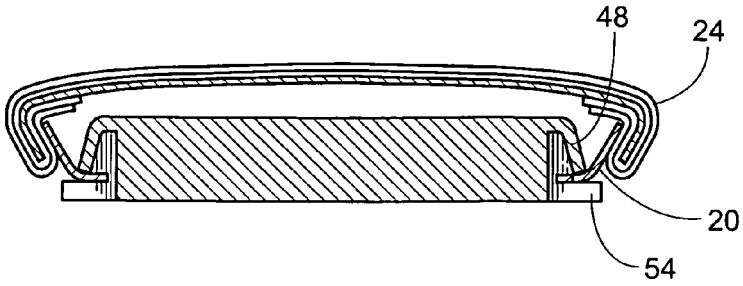
FIG. 9 is a side sectional view similar to FIG. 7, except showing a button mounted to the button engaging and attachment structure.

As can be seen in FIG. 4, the back portion 44 comprises a button support rim 54 extending from the front portion 42. The rim 54 has a diameter D2 (see FIG. 6), which preferably is greater than the diameter D1 of the button engaging segment 46. (IS A RIM A REQUIREMENT? IF A RIM IS NOT PROVIDED, AND THE TOLERANCES TIGHTENED, WOULDN'T THE BUTTON STILL STAY ON, BUT MAYBE BE SOMEWHAT MOVEABLE?) The button support rim 54 may include one or more gaps 56. A gap 56 may be in general alignment with an associated button engaging tab 48. The gap 56 serves to allow a tool, such as a flat head screw driver 57, for example, to be inserted under a button engaging tab 48 to disengage the engaged button 24 (see FIGS. 9 and 10). In one embodiment, there are no gaps 56 in the rim 54. In alternative embodiments, one or more gaps may be provided.

Figure 5:
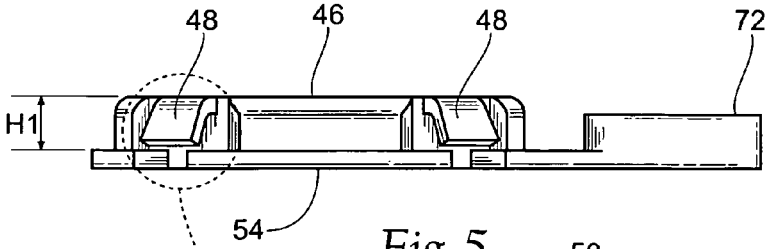
FIG. 5 is a side view of the button engaging and attachment structure shown in FIG. 4.
Figure 5A:
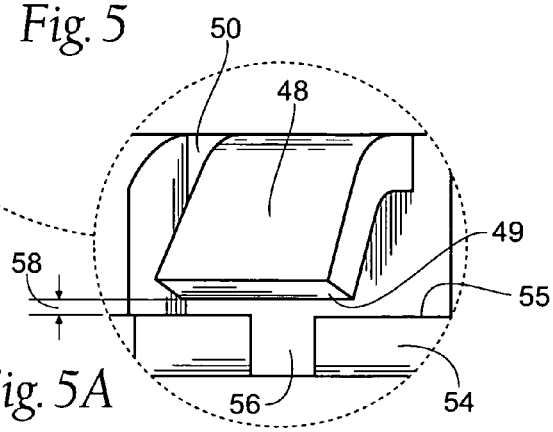
FIG. 5A is a close-up side view of the button engaging and attachment structure shown in FIG. 4, showing the button engaging tab and associated clearance between the button engaging tab and the button support rim to allow the button to extend under the button engaging tab and rest on the button support rim.
Figure 6:
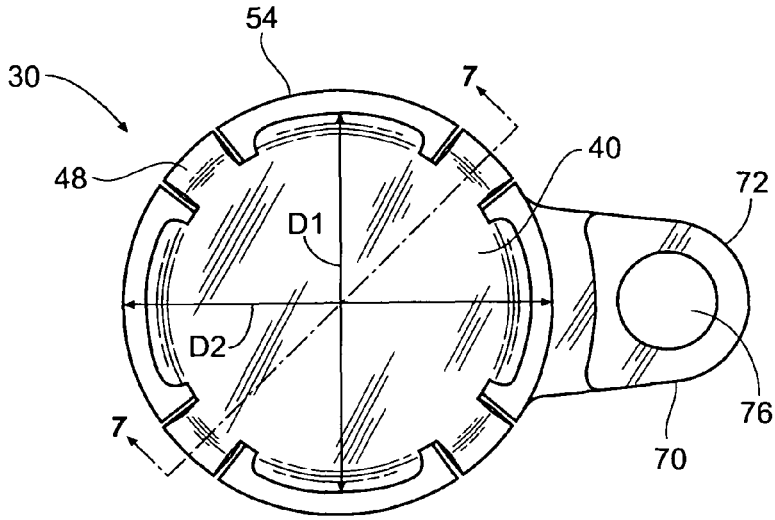
FIG. 6 is a plan view of the button engaging and attachment structure shown in FIG. 4.
Figure 7:
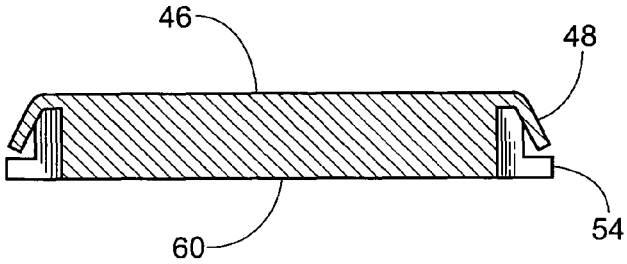
FIG. 7 is a side sectional view taken along line 7-7 in FIG. 6, showing the button engaging and attachment structure without a button.
Figure 8:
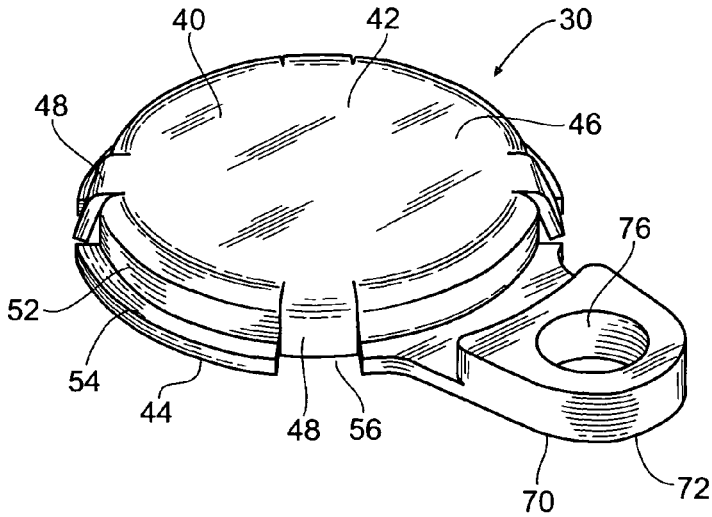
FIG. 8 is a perspective view of an alternative embodiment of a button engaging and attachment structure.

As can be seen in FIG. 4, the button engaging tab or tabs 48 extend outward from the button engaging segment 46 and may also extend downward from the button engaging segment 46, toward the button support rim 54. A minimum clearance 58 is preferably provided between the bottom edge 49 of the engaging tab 48 and the upper surface 55 of the rim 54 (see FIG. 5A). This minimum clearance 58 allows the button 24, when pushed onto the front portion 42, to extend under the button engaging tab 48 and rest on the button support rim 54 (see FIG. 9).

Figure 10A:
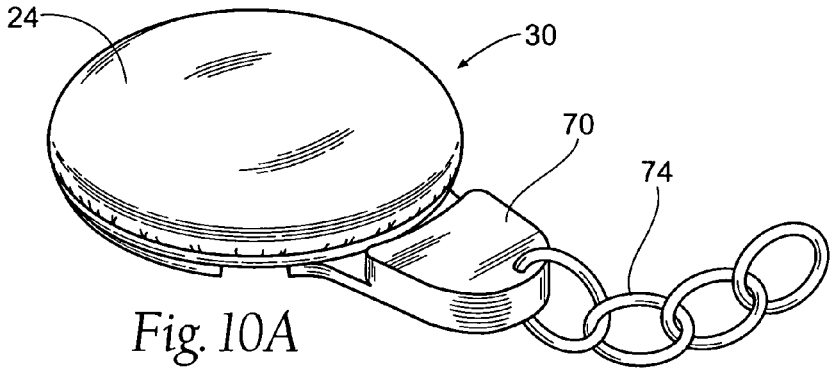
FIGS. 10A through 10C are perspective views of an embodiment of the button engaging and attachment structure showing a button coupled to the button engaging and attachment structure, and showing options for the means for attachment integral with the carrier attachment portion.
Figure 10B:
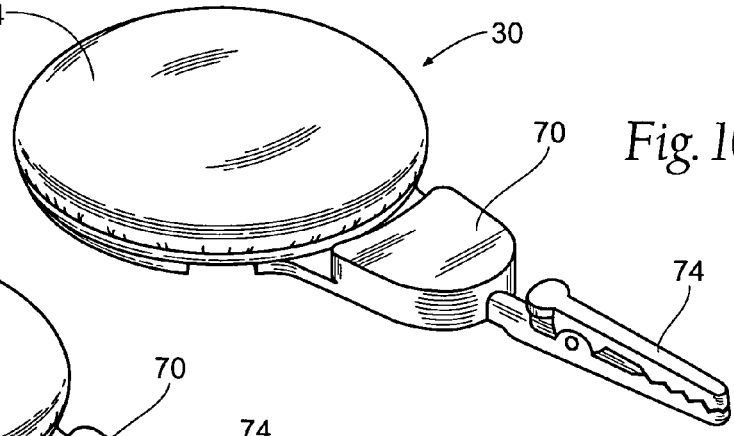
Figure 10C:
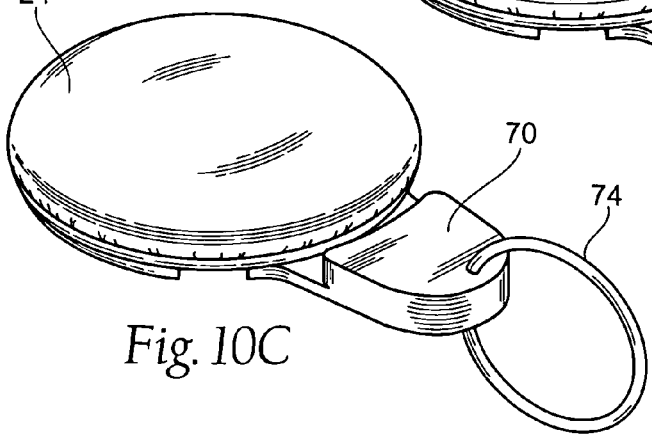

The carrier attachment portion 70 is adapted to extend from the button engaging portion 40. As shown, the carrier attachment portion comprises a tab 72 extending from the button support rim 54. As previously described with the button engaging portion 40, the carrier attachment portion 70 can take on a variety of configurations suited for attachment to variety of host carriers. The tab 72 may include an aperture 76 formed therein for attachment to a host carrier, or the aperture 76 may be used to couple to the means 74 for attachment such as chains, key chains, clips, alligator clips, rings, and the like known in the art, as shown in FIG. 4 as a non-limiting example. Alternatively, the tab 72 may be integrated with or coupled to the means 74 for attachment 74, as shown in FIGS. 10A through 10C, as non-limiting examples.

Figure 11:
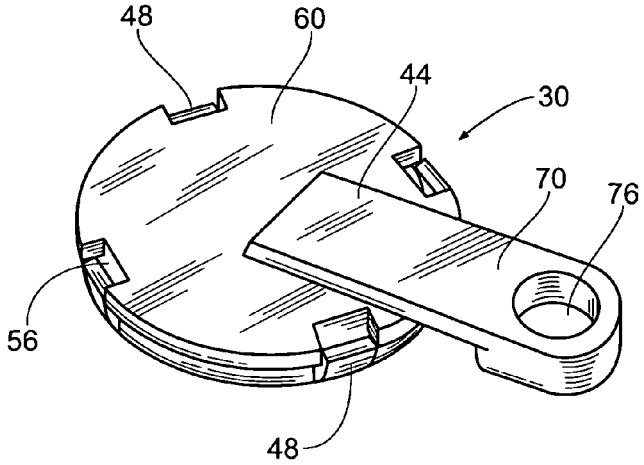
FIG. 11 is a perspective view of the back side of the button engaging and attachment structure, showing an alternative carrier attachment portion.
Figure 12:
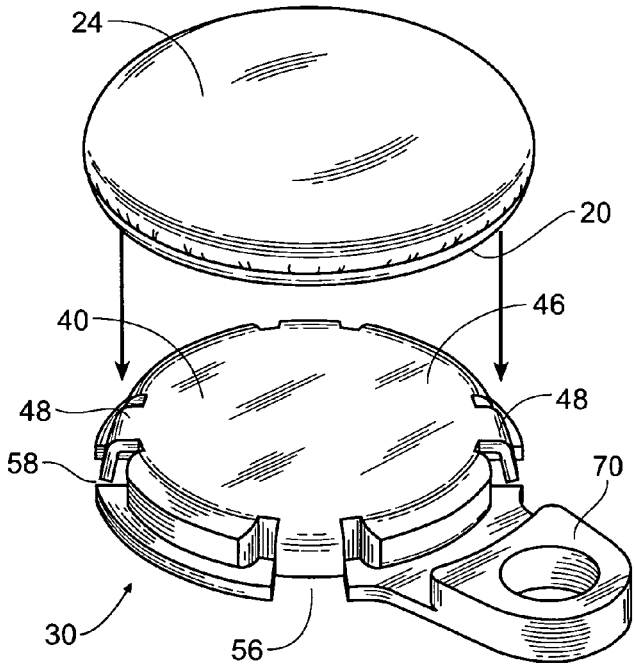
FIG. 12 is a perspective view showing a button engaging and attachment structure similar to FIG. 4, and a button ready to be coupled to the button engaging and attachment structure.

In one embodiment, the carrier attachment portion 70 may couple to and/or extend from the back support rim 54. In an alternative embodiment, the carrier attachment portion 70 may be coupled to and/or extend from the back side 60 of the back portion 44 (see FIG. 11). The carrier attachment portion 70 is configured to provide clearance for the button 24 to be mounted on the raised button engaging segment 46.

Figure 13:
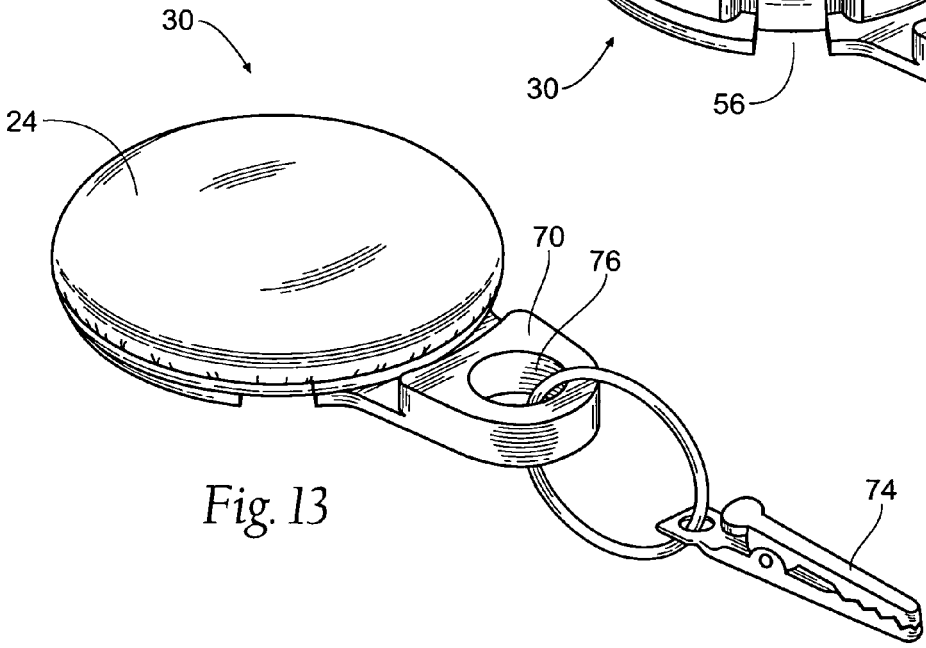
FIG. 13 is a perspective view similar to FIG. 13, showing the button coupled to the button engaging and attachment structure, and including a means for attachment coupled to the carrier attachment portion.
Figure 14:
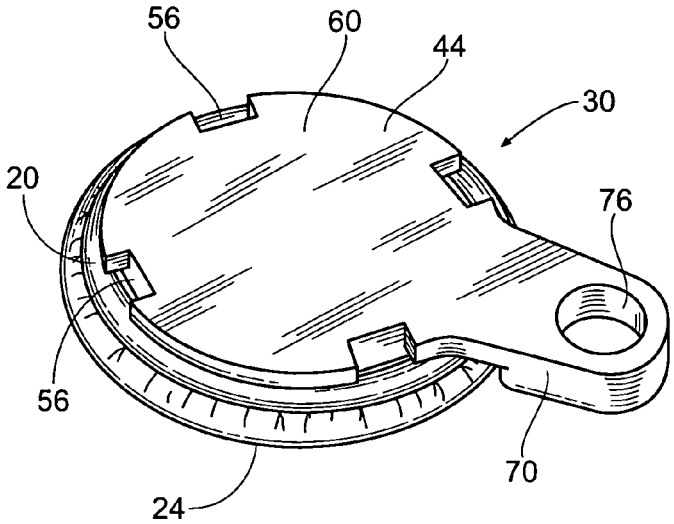
FIG. 14 is a perspective view of the button engaging and attachment structure shown in FIG. 14, showing the back side of the button engaging and attachment structure.

In use, a button 24 is simply and conveniently coupled to the button engaging and attachment structure 30. A button 24 having a collet 20, or other known button configurations, is simply placed on the raised button engaging segment 46, and a downward pressure is applied to the button 24, causing the button engaging tabs 48 to flex inward, allowing the collet 20 of the button 24 to slide underneath the button engaging tabs 48 and into the minimum clearance space 58, securing the button 24 to the button engaging and attachment structure 30. The button engaging and attachment structure 30 supporting the button 24 is shown in FIGS. 13 and 14.

In yet an additional alternative embodiment shown in FIGS. 15 through 18, a button engaging and attachment structure 300 comprises a double button engaging portion 340 and a carrier attachment portion 70, and is adapted to support two buttons 24*a* and 24*b*.

Figure 16:
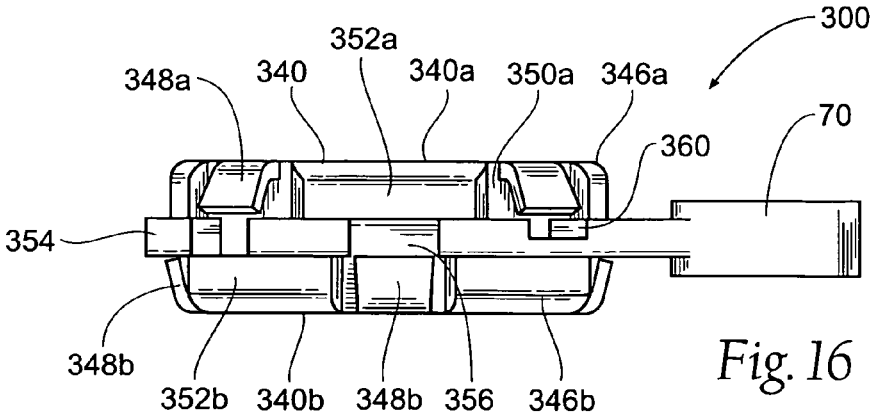
FIG. 16 is a side view of an additional embodiment of a button engaging and attachment structure adapted to support two buttons, one on a front side and one on a back side, the rim including both a gap and a step.
Figure 17:
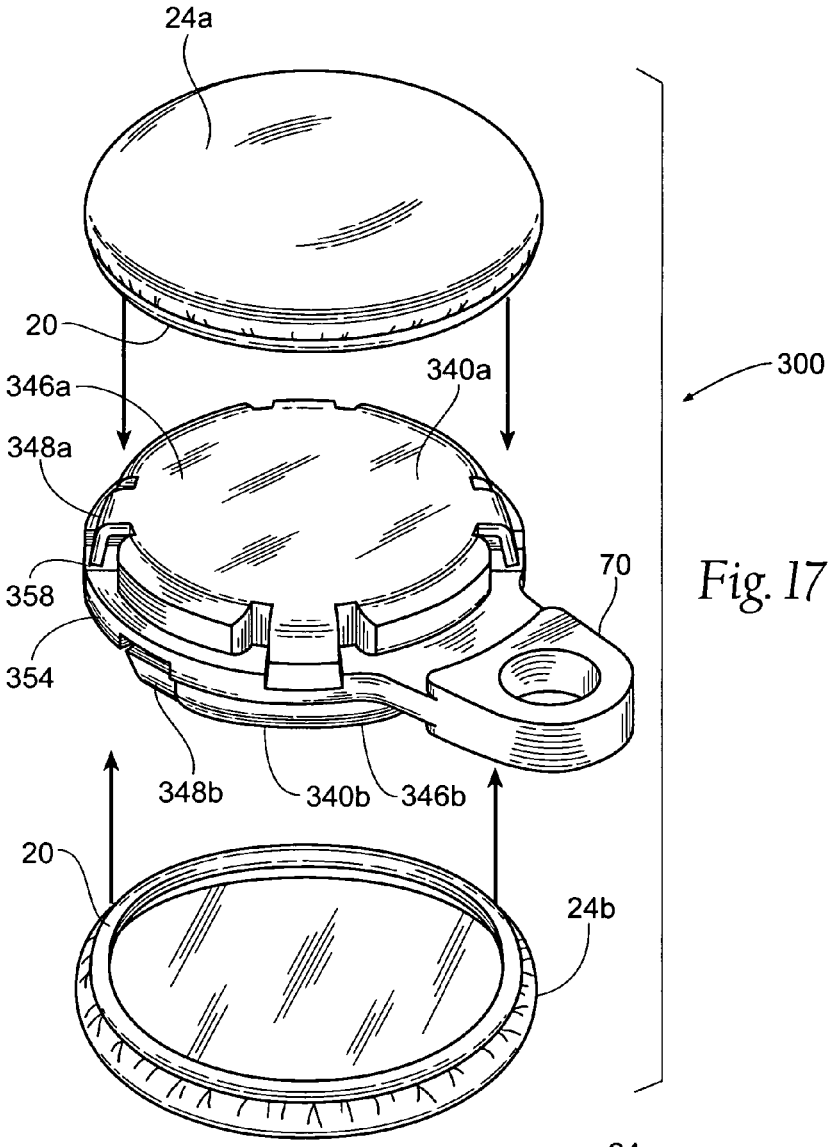
FIG. 17 is an exploded perspective view of the button engaging and attachment structure shown in FIG. 15, with a first button ready to be coupled to the front of the button engaging and attachment structure, and a second button ready to be coupled to the back of the button engaging and attachment structure.

A button support rim 354 may be sandwiched between a first side button engaging portion 340*a* and a second side button engaging portion 340*b*. The button support rim 354 may include a stepped portion or step 360 which does not extend the full thickness of the rim 354, for each button engaging tab 348*a*, 348*b* (see FIG. 16). Alternatively, and as shown in FIG. 16, the button support rim 354 may include a gap 356 in place of a step 360, for each button engaging tab 348*a*, 348*b* from the first side and/or the second side. Or, a combination of gaps 356 and steps 360 may be used.

Figure 15:
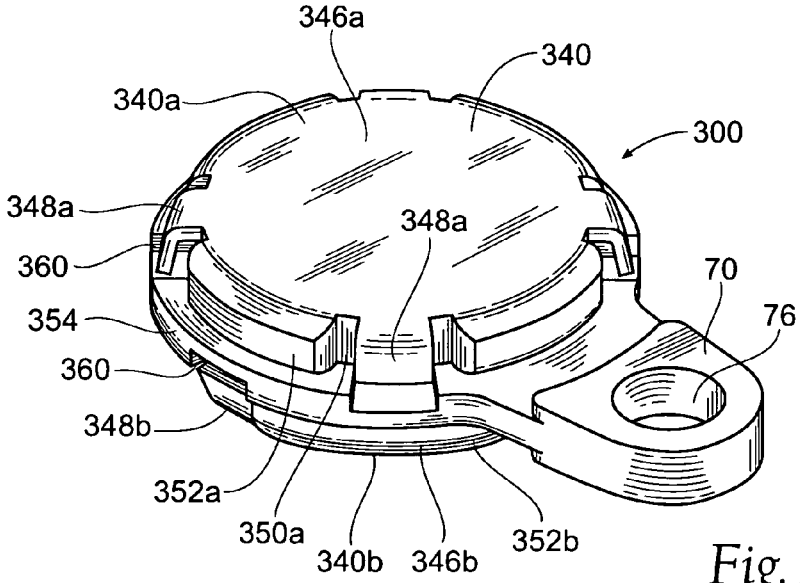
FIG. 15 is a perspective view of an additional embodiment of a button engaging and attachment structure adapted to support two buttons, one on a front side and one on a back side.

Similar to the button engaging and attachment structure 30, in one embodiment, the button engaging tabs 348*a*, 348*b* extend from a recess 350*a*, 350*b* in the outer edge 352*a*, 352*b* of the respective button engaging segments 346*a*, 346*b* as seen in FIGS. 15 and 16, and in an alternative embodiment, the button engaging tab 348*a*, 348*b* extend from the outer edge 352*a*, 352*b* of the button engaging segments 346*a*, 346*b*. It is to be appreciated that extending from the button engaging segments 346*a*, 346*b*, can include extending from any portion of the raised button engaging segments 346*a*, 346*b*.

As can be seen in FIGS. 15 and 16, there may be a misalignment of the button engaging tabs on the first side 348*a* and the button engaging tabs on the second side 348*b*, i.e., there is an offset between a button engaging tab 348*a* on the first side and a button engaging tab 348*b* on the second side. The misalignment is adapted to allow a tool access to the button engaging tabs on either or both the first side 340*a* and the second side 340*b* for removal of buttons 24*a* and 24*b* attached to the first side and the second side.

Figure 18:
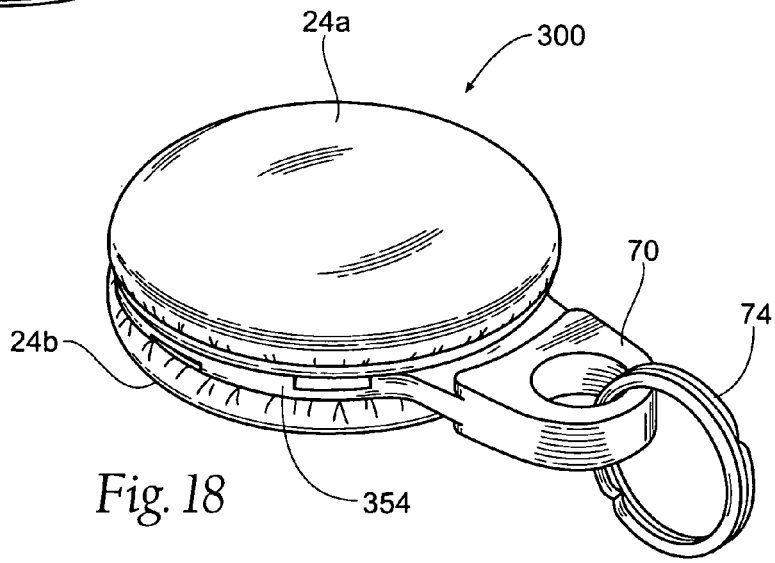
FIG. 18 is a perspective view similar to FIG. 17, showing the first button coupled to the front of the button engaging and attachment structure, and the second button coupled to the back of the button engaging and attachment structure.

In use, a first button is simply and conveniently coupled to the button engaging and attachment structure 300. A button 24*a* having a collet 20, or other known button configurations, is simply placed on the first side raised button engaging segment 346*a*, and a downward pressure is applied to the button 24*a*, causing the button engaging tabs 348*a* to flex inward, allowing the collet 20 of the button 24*a* to slide underneath the button engaging tabs 348*a* and into the minimum clearance space 358, securing the button 24*a* to the button engaging and attachment structure 300. The process is simply repeated to attach a second button 24*b* to the second side raised button engaging segment 346*b*. The button engaging and attachment structure 300 supporting two buttons 24*a* and 24*b* is shown in FIG. 18.

Figure 19:
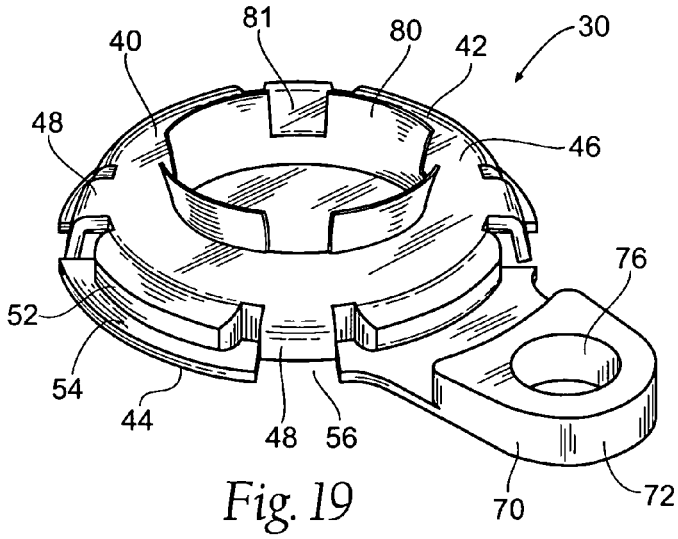
FIG. 19 is a perspective view of a second alternate embodiment of a button engaging and attachment structure, including a crown structure.

Referring now to FIG. 19, a perspective view of a second alternate embodiment of a button engaging and attachment structure 30, including a crown structure 80 is shown. The crown structure 80 is provided with somewhat flexible upright members separated by voids 81. Crown structure 80 is preferably of suitable flexible material that the crown structure 80 will bend when a button 24 is deployed on the button engaging and attachment structure 30. The crown structure 80 is intended to provide a firm fit between the button 24 and the button engaging and attachment structure 30, such that the button 24 does not have much looseness and does not rattle when worn.

Figure 20:
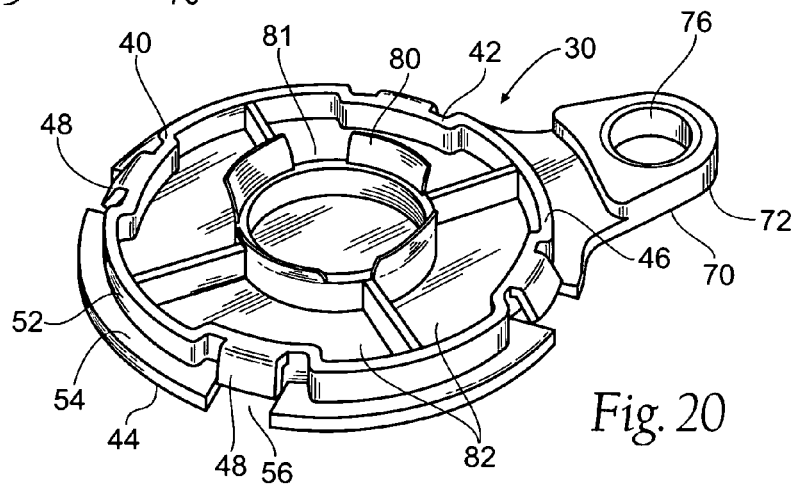
FIG. 20 is a perspective view of a third alternate embodiment of a button engaging and attachment structure, including a crown structure and a stock saving structure.

Referring now to FIG. 20, a perspective view of a third alternate embodiment of a button engaging and attachment structure 30 is shown, including the crown structure 30, and also including stock saving void spaces 82. The purposes of these stock saving void spaces 82 is to reduce the amount of raw material used.

Figure 21:
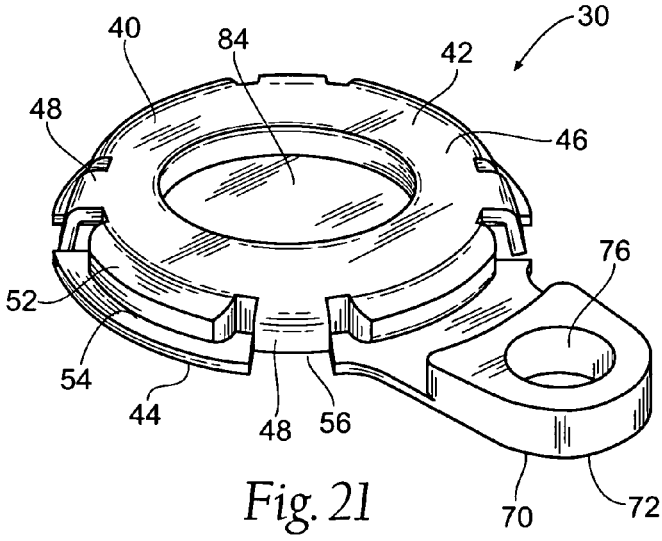
FIG. 21 is a perspective view of a third alternate embodiment of a button engaging and attachment structure, including a stock saving structure.

Referring now to FIG. 21 a perspective view of a third alternate embodiment of a button engaging and attachment structure 30 is shown, including a stock saving structure 84, again for the purpose of reducing the amount of raw material used.

Figure 22:
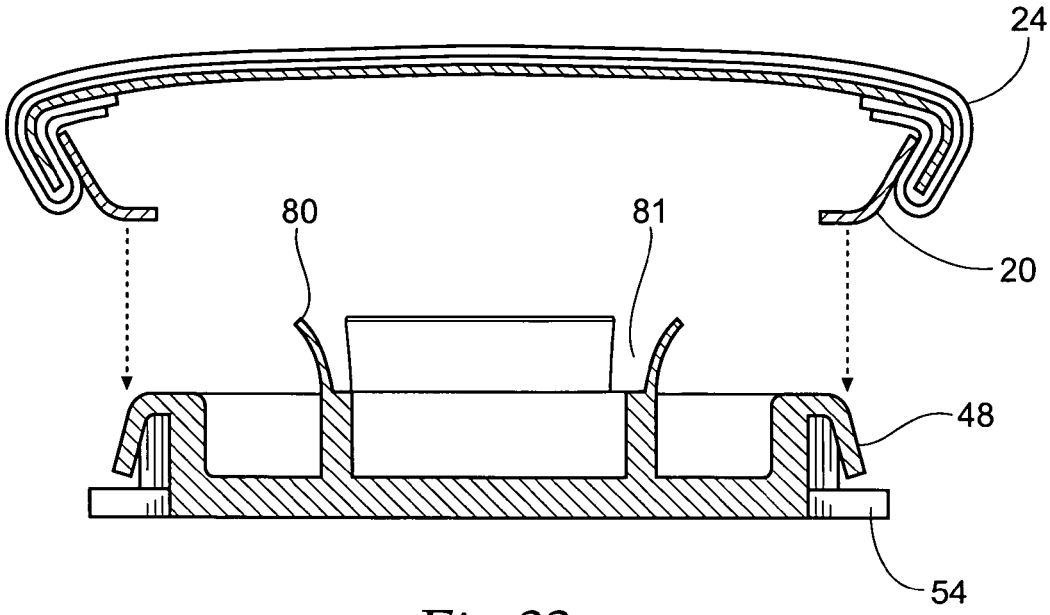
FIG. 22 is an exploded side view of the second alternate embodiment of a button engaging and attachment structure, including a crown structure prepared to receive the button.
Figure 23:
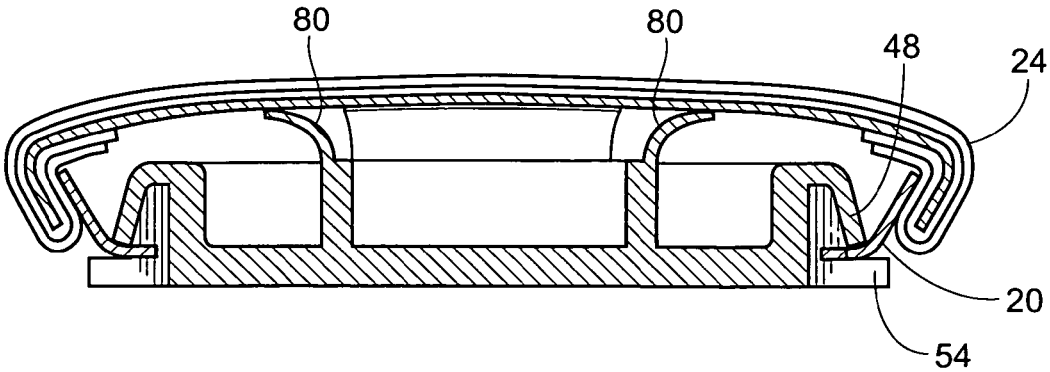
FIG. 23 is an assembled side view of the second alternate embodiment of a button engaging and attachment structure, including a crown structure engaging the button.

Referring now to FIG. 22, an exploded side view of the second alternate embodiment of a button engaging and attachment structure 30 is shown, including the crown structure 80 prepared to receive the button 24. As can be seen with reference to FIG. 23, the crown structure 80 has flexed and received the button 24, yet will retain some upward bias or flex in order to reduce looseness or play between the button engaging and attachment structure 30 and the button 24. In this manner the button engaging and attachment structure 30 and the button 24 are both quieter and retain the intended orientation of graphics contained on the button 24 (not shown).

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A structure for engaging a component of a button, the structure comprising:

a button engaging portion, the button engaging portion comprising a front portion and a back portion, the front portion comprising a button engaging segment having one or more button engaging tabs extending therefrom, the back portion comprising a rim, and a carrier attachment portion comprising a tab adapted to couple to a host carrier, the carrier attachment portion being coupled to the button engaging portion;

wherein the rim includes one or more gaps.

2. The structure according to claim 1:

wherein the tab includes an aperture to couple to the host carrier.

3. The structure according to claim 1:

wherein the tab includes an aperture to couple to means for attachment.

4. The structure according to claim 1:

wherein the tab is integral with means for attachment.

5. The structure according to claim 1:

wherein the carrier attachment portion is coupled to the back portion rim.

6. The structure according to claim 1:

wherein the button engaging tab is adapted to restrain a collet from a mounted button.

7. The structure according to claim 1:

wherein the button engaging portion and the carrier attachment portion is a unitary structure.

8. The structure according to claim 1:

wherein the button engaging portion and the carrier attachment portion comprise a plastic material.

9. The structure according to claim 1:

wherein an engaged button in non-removable.

10. The structure according to claim 1:

wherein an engaged button in removable.

11. The structure according to claim 1:

wherein the gap is aligned with the button engaging tab.

12. A structure for engaging a component of a button, the structure comprising:

a button engaging portion, the button engaging portion comprising a first button engaging segment having one or more first button engaging tabs extending therefrom, and a second button engaging segment having one or more second button engaging tabs extending therefrom, and a rim positioned between the first button engaging segment and the second button engaging segment, and a carrier attachment portion comprising a tab adapted to couple to a host carrier, the carrier attachment portion being coupled to the button engaging portion;

wherein the rim includes one or more gaps.

13. The structure according to claim 12:

wherein the rim includes one or more steps.

14. A structure for engaging a component of a button, the structure comprising:

a button engaging portion, the button engaging portion comprising a first button engaging segment having one or more first button engaging tabs extending therefrom, and a second button engaging segment having one or more second button engaging tabs extending therefrom, and a rim positioned between the first button engaging segment and the second button engaging segment, and a carrier attachment portion comprising a tab adapted to couple to a host carrier, the carrier attachment portion being coupled to the button engaging portion:

wherein the first button engaging tab is misaligned with the second button engaging tab.

* * * * *